United States Patent [19]

Sakata et al.

[11] Patent Number: 5,061,611

[45] Date of Patent: Oct. 29, 1991

[54] METHODS FOR PRODUCING AND PRESERVING A SILVER HALIDE PHOTOGRAPHIC LIGHT-SENSITIVE MATERIAL

[75] Inventors: Hideaki Sakata, Hachioji; Toshiharu Nagashima; Akira Kobayashi, both of Hino, all of Japan

[73] Assignee: Konica Corporation, Tokyo, Japan

[21] Appl. No.: 517,045

[22] Filed: May 1, 1990

[30] Foreign Application Priority Data

May 1, 1989 [JP] Japan ..... 1-112466
Oct. 30, 1989 [JP] Japan ..... 1-282511

[51] Int. Cl.[5] ..... G03C 1/76

[52] U.S. Cl. ..... 430/533; 430/534; 430/535; 430/349; 430/935; 430/939; 427/377; 427/379

[58] Field of Search ..... 430/349, 533, 534, 535, 430/935, 939; 427/377, 379

[56] References Cited

U.S. PATENT DOCUMENTS 4,645,731 2/1987 Bayless et al. ..... 430/533
4,699,869 10/1987 Bayless et al. ..... 430/535
4,933,267 6/1990 Ishigaki et al. ..... 430/533
4,946,769 8/1990 Arai et al. ..... 430/539
4,977,071 12/1990 Kanetake et al. ..... 430/533
4,994,353 2/1991 Hatakeyama et al. ..... 430/533

FOREIGN PATENT DOCUMENTS 0056817 5/1979 Japan ..... 430/533

*Primary Examiner*—Charles L. Bowers, Jr.
*Assistant Examiner*—Thomas R. Neville
*Attorney, Agent, or Firm*—Finnegan, Henderson, Farabow, Garrett and Dunner

[57] ABSTRACT

A method of preparing a light sensitive silver halide phtographic material is disclosed. The photographic material comprises a polyester support having a hydrophobic polymer layer containing a vinylidene chloride copolymer and at least one hydrophilic polymer layer. The method comprises steps of coating a hydrophilic polymer layer onto the polyester support, drying the layer until a water content of the layer reaches 60 wt %, and contacting the layer with air having a relative humidity of 5 to 25% for a period 5 seconds to 10 minutes. The photographic material according to the method has such a physical characteristics as dimensional stability for long time storage or anti-cracking of the photographic layer at the preparation period. It is suitable for printing use.

6 Claims, No Drawings

METHODS FOR PRODUCING AND PRESERVING A SILVER HALIDE PHOTOGRAPHIC LIGHT-SENSITIVE MATERIAL

FIELD OF THE INVENTION

The present invention relates to a method for producing a silver halide photographic light-sensitive material having improved physical characteristics and a method for preserving the same light-sensitive material, and more particularly to a method for producing a silver halide photographic light-sensitive material having layers excellent in the dimensional stability, the surface of which is little or not cracked even when dried in a low relative-humidity atmosphere, and a method for preserving the light-sensitive material in which the material is so packed and sealed as not to undergo dimensional changes even when stored over a long period of time.

BACKGROUND OF THE INVENTION

A silver halide photographic light-sensitive material generally has, on at least one side of its support, a layer of a hydrophilic polymer such as gelatin, a binder for silver halide grains. Such a hydrophilic layer is liable to be dimensionally changed according to changes in temperature and humidity.

The light-sensitive material's dimensional change attributable to the elongation or shrinkage of its hydrophilic polymer layer is a very serious problem to graphic arts light-sensitive materials which are required to achieve halftone image and precision line drawing reproductions for multicolor printing.

Japanese Patent Examined Publication Nos. 4272/1964, 702/1964, 13482/1968 and 5331/1970; U.S. Pat. Nos. 2,763,625, 2,772,166, 2,852,386, 2,853,457, 3,397,988, 3,411,911 and 3,411,912 describe the incorporation of a polymer latex into a hydrophilic polymer layer to obtain a photographic light-sensitive material which is scarcely dimensionally changed. i.e., excellent in the dimensional stability.

However, the incorporation of a polymer latex into the hydrophilic polymer layer of a light-sensitive material often adversely affects the layer's physical strength, wear resistance and adherence to its support.

For example, U.S. Pat. Nos. 3,459,790, 3,488,708, 3,554,987, 3,700,456 and 3,939,130: and British Patent No. 1,492,701 describe using in the hydrophilic polymer layer a polymer having an active methylene group capable of reacting with an agent for hardening gelatin in order to get rid of the adverse effect by the above polymer latex. These methods enable to obtain a good dimensional stability to some extent without impairing the layer's physical strength and wear resistance in a developer solution, but are still insufficient to meet the demand for multicolor image and precision line drawing reproductions in the printing field.

Japanese Patent Publication Open to Public Inspection (hereinafter called Japanese Patent O.P.I. Publication) No. 3627/1985 discloses a dimensional stability improving technique to use a polyester film support with its both sides laminated with a polyolefin. The techniques, however, is still not sufficient for practical use.

For the dimensional stability improvement, Japanese Patent O.P.I. Publication No. 230035/1964 proposes a drying process in which a hydrophilic polymer coat layer is brought into contact for a period of more than 5 seconds and less than one minute with air having a relative humidity of 25% to 5% within 5 minutes after the point of time when the average surface temperature of the layer is increased up to a temperature 1° C. lower than the average temperature of the air for drying. The proposed drying process is effective in dimensional stability improvement, but the drying under such a low relative humidity air condition is liable to cause the layer to crack and, if a silver halide photographic light-sensitive material is packed in a container under such the air condition, may possibly deteriorate its dimensional stability in time.

SUMMARY OF THE INVENTION

It is an object of the present invention to provide a method for producing a silver halide photographic light-sensitive material having component layers which suffer no crack trouble and have excellent dimensional stability in the drying process, particularly under a low-humidity drying condition, following the coating process thereof.

It is another object of the present invention to provide a sealing method for preserving the silver halide photographic light-sensitive material produced according to the invention so that, even when the light-sensitive material is stored over a long period of time, the dimensional stability thereof be not impaired.

The light-sensitive material of the invention comprises a polyester support having thereon a hydrophobic polymer layer containing a vinylidene chloride copolymer and at least one hydrophilic polymer layer provided thereon. At least one of the hydrophilic polymer layers is a light-sensitive silver halide emulsion layer containing light-sensitive silver halide grains. The hydrophilic polymer layer is formed by providing an aqueous hydrophilic polymer solution from a coater onto the support and then drying. The hydrophilic polymer layer, when the water content thereof reaches 60%, is substantially dried. The moisture content of the layer is adjusted by bringing the layer into contact with air having a relative humidity of 5 to 25% for a period of 5 seconds to 10 minutes after the drying. The moisture adjusting process is commenced within 2 minutes, preferably within one minute after the water content of the hydrophilic polymer layer reaches 60%.

DETAILED DESCRIPTION OF THE INVENTION

The vinylidene chloride copolymer used in the invention is a copolymer containing preferably 70 to 99.5% by weight, and more preferably 85 to 99% by weight vinylidene chloride. Examples of the copolymer include the copolymers of the vinylidene chloride/acrylate/vinyl monomer having an alcohol in its side chain described in Japanese Patent O.P.I. Publication No. 135526/1976: the vinylidene chloride/alkyl alkylate/acrylic acid described in U.S. Pat. No. 2,852,378: the vinylidene chloride/acrylonitrile/itaconic acid described in U.S. Pat. No. 2,698,235: and the vinylidene chloride/alkyl acrylate/itaconic acid described in U.S. Pat. No. 3,788,856. These copolymers may be used alone or in a mixture.

The following are particular examples of the above copolymer of the invention:

(Parenthesized numbers are in ratio by weight)

1) Vinylidene chloride : methyl acrylate : hydroxyethyl acrylate (83 : 12 : 5),

2) Vinylidene chloride : ethyl methacrylate : hydroxypropyl acrylate (82 : 10 : 8),
3) Vinylidene chloride : methyl acrylate : 3-chloro-2-hydroxy propyl acrylate (84 : 9 : 7)
4) Vinylidene chloride : methyl acrylate : N-ethanolacryl amide (85 : 10 : 5),
5) Vinylidene chloride : hydroxydiethyl methacrylate (92 : 8)
6) Vinylidene chloride : methyl methacrylate : acrylonitrile (90 : 8 : 2),
7) Vinylidene chloride : butyl acrylate : acrylic acid (94 :4 : 2),
8) Vinylidene chloride : butyl acrylate : itaconic acid (75 : 20 : 5),
9) Vinylidene chloride : methyl methacrylate : itaconic acid (90 : 8 : 2),
10) Vinylidene chloride : methyl acrylate : methacrylic acid (93 : 4 : 3),
11) Vinylidene chloride : itaconic acid monoethyl ester (96 : 4)
12) Vinylidene chloride : acrylonitrile : acrylic acid (96 : 3.5 : 1.5),
13) Vinylidene chloride : methyl acrylate : acrylic acid (90 : 5 : 5),
14) Vinylidene chloride : ethyl acrylate : acrylic acid (92 : 5 : 3), and
15) Vinylidene chloride : methyl acrylate : acrylic acid (90 : 5 : 5).

Any of these copolymers may be coated on a polyester film prior to sequential biaxial orientation or simultaneous biaxial orientation, after monoaxial orientation but before reorientation, or after biaxial orientation and thermal setting.

Particularly preferred are a method in which an aqueous dispersion or solution of the copolymer is coated on a monoaxially roll-oriented polyester film and then dried or not dried, and thereupon the film is oriented in the direction perpendicular to that of the earlier orientation and then heated, and another for coating the copolymer on a biaxially oriented polyester support.

A solution of the vinylidene chloride copolymer dissolved in an appropriate organic solvent or an aqueous dispersion of the vinylidene chloride is coated on a polyester film. The coating may be carried out by a generally known coating method such as a dip-coating method, air-knife-coating method, curtain-coating method, roller-coating method, wire-bar-coating method, gravure-coating method, or the extrusion-coating method utilizing a hopper described in U.S. Pat. No. 2,681,294.

Examples of the above organic solvent include alcohols such as methanol and fluorinated alcohol; glycols such as diethylene glycol and triethylene grycol; amines such as diethylamine and triethanolamine; and ethyl acetate, acetone, and the like.

The polymer can be coated over a polyester support by a so-called extrusion coating method in which the polymer is molten and poured over a polyester film support in transit, and the polymer and the support are sticked together by applying pressure thereto as soon as the polymer is cooled.

In order to improve the adherence of the polymer layer containing the vinylidene chloride to the polyester film, the surface of the polyester film may be subjected to a treatment such as chemical treatment, mechanical treatment, corona discharge treatment, flame treatment, ultraviolet-radiation treatment, high-frequency treatment, glow-discharge treatment, active-plasma treatment, high-pressure vapor treatment, desorption oxidation treatment. Of these treatments, the corona discharge treatment is preferred.

To secure the adherence of the above polymer layer of the invention to the polyester film, there may be added to a coating liquid for forming the layer a polyester-swelling agent such as phenol, resorcinol, o-cresol, m-cresol, trichloroacetic acid, dichloroacetic acid, monochloroacetic acid, chloral hydrate or benzyl alcohol. Examples of the addition of such agents are described in U.S. Pat. Nos. 3,245,937, 3,143,421, 3,501,301 and 3,271,178.

The vinylidene chloride copolymer layer in the invention is preferred to be adequately thick in order to restrain the support from elongating due to water absorption in the course of processing, but if too thick, it deteriorates the layer's adherence to a hydrophilic polymer layer such as the silver halide emulsion layer. The thickness of the vinylidene chloride copolymer layer is preferably 0.3$\mu$ to 5$\mu$, and more preferably 0.5$\mu$ to 2.0$\mu$.

In addition to the vinylidene chloride copolymer, there may be used in combination therewith water-soluble or water-dispersible polyesters, polyamides, polyurethanes, vinyl copolymers, butadiene copolymers, acryl copolymers, epoxy copolymers, silicone copolymers, fluoro copolymers or the like. These are used in a proportion of preferably not more than 30% by weight to the vinylidene chloride copolymer.

A coating liquid containing the vinylidene chloride copolymer as a principal component may contain the copolymer component in an amount of 0.1 to 60% by weight and may, if necessary, also contain additives such as a surface active agent, a hydrophilic organic polymer, a matting agent, a sliding agent, an antistatic agent and a cross-linking agent. As the cross-linking agent there may be used so-called hardeners including aldehyde compounds such as formaldehyde and glyoxal, mucochloric acid; ethyleneimine group-having compounds such as tetramethylene-1,4-bis(ethyleneurea) and hexamethylene-1,6-bis(ethyleneurea); methanesulfonates such as trimethylene-1,3-bismethanesulfonate; active vinyl compounds such as bisacryloylurea and methaxylenevinylsulfonic acid: active halogen-having compounds such as 2-methoxy-4,6-dichlorotriazine and 2-sodium-oxy-4,6ddichlorotriazine: epoxy group-having compounds such as bisphenol-glycidyl ether; and isocyanates.

The polyester used as a support is a polyester comprised principally of a glycol and a dibasic acid such as an aromatic dibasic acid. Typical examples of the dibasic acid include terephthalic acid, isophthalic acid, p-$\beta$-oxyethoxybenzoic acid, diphenylsulfondicarboxylic acid, diphenoxyethanedicarboxylic acid, adipic acid, sebacic acid, azelaic acid, 5-sodium-sulfoisophthalic acid, diphenylenedicarboxylic acid and 2,6-naphthalenedicarboxylic acid. Examples of the glycol include ethylene glycol, propylene glycol, butanediol, neopentylene glycol, 1,4-cyclohexanediol, 1,4-cyclohexanedimethanol, 1,4-bisoxyethoxybenzene, bisphenol A, diethylene glycol and polyethylene glycol.

Among these polyesters, polyethylene terephthalate is most advantageously used.

The thickness of a polyester film that is used as the support, although not particularly restricted, is about 12$\mu$ to 500$\mu$, and preferably 40$\mu$ to 200$\mu$, which is advantageous for ease of handling. A polyester film that has been subjected to biaxial orientation crystallization is more advantageous from the standpoint of stability and strength.

On the polymer layer is provided a hydrophilic polymer layer.

The polymer most advantageously usable for the above hydrophilic polymer layer is gelatin.

Examples of the polymer except gelatin are colloidal albumin, agar-agar, gum arabic, alginic acid, hydrolyzed cellulose acetate, acrylamide, imidated polyamide, polyvinyl alcohol, hydrolyzed polyvinyl acetate, gelatin derivatives, the phenylcarbamyl gelatin, acylated gelatin and phthalated gelatin described in U.S. Pat. Nos. 2,614,928 and 2,525,753; and those compounds obtained by graft polymerization onto gelatin of ethylene group-having polymerizable monomers such as styrene acrylate, acrylates, methacrylic acid and methacrylates described in U.S. Pat. Nos. 2,548,520 and 2,831,767. These hydrophilic polymers may be used also in layers containing no silver halide, such as antihalation layer, protective layer and intermediate layer.

In order to improve the adherence between the vinylidene chloride layer and the hydrophilic layer, there may be provided a subbing layer capable of adhering to both of the layers.

To form the subbing layer, there may be coated an aqueous solution containing a natural hydrophilic organic colloid such as gelatin or casein, a synthetic hydrophilic colloid, an antistatic agent and those hydrophilic high-molecular compounds as described in Japanese Patent Examined Publication Nos. 24159/1971 and 23828/1974: Japanese Patent O.P.I. Publication No. 93165/1973, and the like. A coating liquid for forming the subbing layer may contain a matting agent, a hardener, a surface active agent and the like. The coating and drying of the subbing layer may be made in the same conventional manner as in the polymer layer. Before coating or after drying the polymer layer and the at-need-provided subbing layer, the support may, if necessary, be subjected to conventional surface treatment such as flame treatment, plasma treatment, corona-discharge treatment, glow-discharge treatment, ultraviolet-irradiation treatment or the like.

On a polyester support each side of which is coated with a polymer layer is coated at least one hydrophilic polymer layer. The coated layer is cooled to be set in a low-temperature air having a dry-bulb temperature of −10° to 15° C., and then dried. For speedy drying, the coated layer is dried at a high temperature: particularly in the drying rang when the water content of the gelatin weight in the gelatin composition of the coated layer is 300% or lower—the so-called falling rate drying, the drying takes place at a high temperature/humidity, i.e., under a high wet-bulb temperature condition. When the water content of the gelatin composition of the coated layer is 60% or lower, the coated layer is substantially dried.

By doing this, there can be obtained a light-sensitive material of which the coated layer is free of crack, excellent in the dimensional stability, and restrained from producing pinholes. The process to bring after the drying the coated layer into contact with air having a relative humidity of 25 to 5% is herein called 'rehumidifying process.'

Where the hydrophilic polymer coating liquid is coated on both sides of the polyester support, the rehumidifying process may be applied to the coated layer on at least one side of the support, and preferably to the coated layers on both sides of the support.

The manufactured silver halide photographic light-sensitive material is put in a moisture-tight package container, and its mouth is hermetically sealed in a heat-sealing manner or the like so that the container's inside is kept at a temperature of 18 to 30° C. and a relative humidity of 5 to 39% and the light-sensitive material is equilibrated with the temperature/humidity condition. If the sealed container's inside temperature should be in the range of from 18° to 30° C. and relative humidity from 5 to 39%, the temperature and humidity conditions in the coating/drying zone, windup room and rooms in the packaging line are not restricted: manufacture of the silver halide light-sensitive material can be carried out under the usual temperature and humidity conditions employed by those in the art.

A packing material to be enclosed along with the light-sensitive film in a packaging container is also preferably conditioned at 18° C. to 30° C. and 5% to 39% RH and then sealed. More preferably, the packing material is heated and then conditioned at 23° C. and 20% RH to make its water content 2% to 6% by weight, and then heat-sealed.

The packaging container may be in any form as long as it can enclose the silver halide light-sensitive material by hermetically sealing. The container can be diversely shaped according to the use and form of the light-sensitive material to be packaged. Generally, a bag hermetically sealable by heat is suitably used. The packaging bag is made preferably of a polyethylene film having a small water-vapor-permeability. Normally, the polyethylene contains carbon black to make it lighttight and other substance not adversely affecting the light-sensitive material for the purpose of making the polyethylene's surface slidable. Particularly, the packaging materials described in Japanese Patent O.P.I. Publication Nos. 6754/1982, 132555/1983 and 189936/1986 are preferred.

The silver halide in the silver halide emulsion used in the invention is, e.g., silver bromide, silver iodobromide, silver iodochloride, silver chlorobromide or silver chloride, and preferably silver chlorobromide or silver chloroiodobromide containing not less than 60 mole% silver chloride for a negative-type silver halide emulsion, and silver chlorobromide, silver bromide and silver iodobromide containing not less than 10 mole% silver bromide for a positive-type silver halide emulsion.

The silver halide emulsion used in the invention may have a compound known as an antifoggant or stabilizer to those in the art added thereto during its chemical ripening, upon completion of its chemical ripening and/or during the period from completion of its chemical ripening up to its coating, for the purpose of preventing it from fogging or keeping its photographic characteristics stable during the manufacture, storage or processing of the light-sensitive material.

Further, the light-sensitive material of the invention may contain as needed various photographic additives such as gelatin plasticizer, hardener, surfactant, image stabilizer, ultraviolet absorbing agent, antistain agent, pH adjusting agent, antioxidant, antistatic agent, viscosity increasing agent, graininess improving agent, dyes, mordant, brightening agent, developing rate adjusting agent and matting agent.

Useful examples of the plasticizer include those as described in Japanese Patent O.P.I. Publication No. 63715/1973, British Patent No. 1,239,337, U.S. Pat. Nos. 306,470, 2,327,808, 2,759,821, 2,772,166, 2,835,582, 2,860,980, 2,865,792, 2,904,434, 2,960,404, 3,003,878, 3,033,680, 3,173,790, 3,287,289, 3,361,565, 3,397,988, 3,412,159, 3,520,694, 3,520,758, 3,615,624, 3,635,853, 3,640,721, 3,656,956, 3,692,753 and 3,791,857.

Examples of the hardener include the aldehyde and aziridine compounds described in PB Report 19,921, U.S. Pat. Nos. 2,950,197, 2,964,404, 2,983,611 and 3,271,175, Japanese Patent Examined Publication No. 40898/1971, and Japanese Patent O.P.I. Publication No. 91315/1975; the isooxazole-type compounds described in U.S. Pat. No. 331,609; the epoxy compounds described in U.S. Pat, No. 3,047,394, West German Patent No. 1,085,663, British patent No. 1,033,518, and Japanese Patent Examined Publication No. 35495/1973; the vinylsulfone compounds described in PB Report 19,920, West German Patent Nos. 1,100,942, 2,337,417, 2,545,722, 2,635,5128, 2,742,308 and 2,749,260, British Patent No. 1,251,091, Japanese Patent Examined Publication Nos. 13563/1974 and 110996/1948, U.S. Pat. Nos. 3,539,644 and 3,490,911; the acryloyl compounds described in Japanese Patent O.P.I. Publication No. 116154/1974 and U.S. Pat. No. 3,640,720; the carbodiimide compounds described in U.S. Pat, Nos. 2,938,892, 4,043,818 and 4,061,499, Japanese Patent Examined Publication No. 38715/1971 and Japanese Patent Application No. 15095/1974: the triazine compounds described in West German Patent Nos. 2,410,973 and 2,553,915, U.S. Pat. No. 3,325,287 and Japanese Patent O.P.I. Publication No. 12722/1977: the high-molecular compounds described in British Patent No. 822,061, U.S. Pat. Nos. 3,623,878, 3,396,029 and 3,226,234, Japanese Patent Examined Publication Nos. 18578/1972, 18579/1972 and 48896/1972; maleimide compounds, acetylene compounds, methanesulfonate compounds, and N-methylol compounds. These compounds as the hardener may be used alone or in combination. Useful combination examples are described in West German Patent Nos. 2,447,587, 2,505,746 and 2,514,245, U.S. Pat. Nos. 4,047,957, 3,832,181 and 3,840,370, Japanese Patent O.P.I. Publication Nos. 43319/1973, 63062/1975 and 127329/1977, and Japanese Patent Examined Publication No. 32364/1973. The most preferred hardener is one that reacts with the carboxyl group of gelatin.

Useful examples of the anionic surfactant are those containing acid groups such as carboxyl, sulfo, phospho, sulfate or phosphate groups, which include alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-alkyltaurines, sulfosuccinic acid esters, sulfoalkylpolyoxyethylenealkylphenyl ethers and polyoxyethylenealkylphosphoric acid esters.

Useful examples of the amphoteric surfactant include amino acids, aminoalkylsulfonic acids, aminoalkylsulfuric or phosphoric esters, alkylbetaines and amine oxides.

Useful examples of the cationic surfactant include alkylamine salts, aliphatic or aromatic quaternary ammonium salts, heterocyclic quaternary ammonium salts such as pyridinium and imidazolium, and aliphatic or heterocyclic phosphonium or sulfonium salts.

Useful examples of the nonionic surfactant include saponin (steroid), alkylene oxide derivatives such as polyethylene glycol, polyethylene glycol/polypropylene glycol condensate, polyethylene glycol-alkyl ethers, polyethylene glycol-alkylaryl ethers, polyethylene glycol esters, polyethylene glycol sorbitane esters, polyalkylene glycol alkylamines or amides and polyethylene oxide adducts of silicone; glycidol derivatives such as alkenylsuccinic acid polyglyceride and alkylphenol polyglyceride; fatty acid esters of polyhydric alcohols, and alkyl esters of sugar.

Useful examples of the matting agent include the organic matting agents described in British Patent No. 1,055,713, U.S. Pat. Nos. 1,939,213, 2,221,873, 2,268,662, 2,322,037, 2,376,005, 2,391,181, 2,701,245, 2,992,101, 3,079,257, 3,262,782, 3,516,832, 3,539,344, 3,591,379, 3,754,924: and the inorganic matting agents described in West German Patent No. 2,592,321, British Patent Nos. 760,775 and 1,260,772, U.S. Pat. Nos. 1,201,905, 2,192,241, 3,053,662, 3,062,649, 3,257,206, 3,322,555, 3,353,958, 3,370,951, 3,411,907, 3,437,484, 3,523,022, 3,615,554, 3,635,714, 3,769,020, 4,021,245 and 4,029,504.

The antistatic agent is used to restrain static marks from occurring in the manufacturing process. Examples of the agent are described in British Patent No. 1466,600, Research Disclosure Nos. 15840, 16258 and 16630, U.S. Pat. Nos. 2,327,828, 2,861,056, 3,206,312, 3,245,833, 3,428,451, 3,775,126, 3,963,498, 4,025,342, 4,025,463, 4,025,691 and 4,025,704.

A technique to incorporate a polymer latex into the silver halide emulsion layer and backing layer for dimensional stability improvement may be used. Examples of the technique are described in Japanese Patent Examined Publication Nos. 4272/1964, 17702/1964 and 13482/1968, U.S. Pat. Nos. 2,376,005, 2,763,625, 2,772,166, 2,852,386, 2,853,457 and 3,397,988.

The present invention is applicable to various light-sensitive materials such as graphic arts, radiographic, general negative-type, general reversal-type, general positive-type and direct positive-type light-sensitive materials, and provides remarkable effects particularly when applied to graphic arts light-sensitive materials which are required to have a very high dimensional stability.

In the invention, various developing methods such as black-and-white, color and reversal developing methods may be used, and the invention is very effective particularly in performing a processing for graphic arts light-sensitive materials which provide a high-contrast image.

The fixer bath used in the invention contains preferably an aluminum compound in order to increase the hardening effect of the light-sensitive material, and the compound content of the fixer is preferably 0.1 to 3 g in aluminum equivalent per liter.

EXAMPLE 1

FORMATION OF POLYMER LAYER

The surface of a biaxially oriented and thermally set 100μ-thick polyethylene terephthalate film was subjected to corona discharge treatment of 30 $W/m^2/min$.

Next, A coating liquid prepared with 10 cc of the following hydrophobic polymer I, 20 mg of the following surfactant E, 30 mg of hexamethylene-1,6-bis(ethyleneurea) and 90 ml of deionized water was coated in different thicknesses on both sides of the above film, and then dried at 100° C. for one minute.

Further, both-sided polymer coat supports were prepared in the same manner as the above except that the hydrophobic polymer I was replaced by the following hydrophobic polymer II or III.

Hydrophobic polymers (30 wt. % aqueous dispersion):

I: Vinylidene chloride/methyl acrylate/acrylic acid (90 : 5 : 5 wt. %)

II: Glycidyl methacrylate/methyl acrylate/acrylic acid (90 : 5 : 5 wt. %)

III: Glycidyl methacrylate/n-butyl acrylate/styrene (50 : 20 : 30 wt. %)

Surfactant E

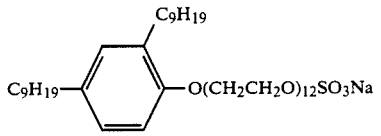

Under a nitric acid atmospheric condition of pH 3.0 at 40° C. with silver potential EAg kept at 170 mV n 1N.NaCl, the following Solutions B and C were mixed into Solution A in 11 minutes by a double-jet method.

| | |
|---|---|
| Solution A | |
| Gelatin | 5.6 g |
| $HO-(CH_2CH_2O)_n-(CH_2CH_2CH_2O)_{17}-(CH_2CH_2O)_m-H$ (wherein n + m = 6) (10% ethanol solution) | 0.56 ml |
| Sodium chloride | 0.12 g |
| Concentrated nitric acid | 0.43 ml |
| Distilled water | 445 ml |
| Solution B | |
| Silver nitrate | 60 g |
| Concentrated nitric acid | 0.208 ml |
| Distilled water | 85.2 ml |
| Solution C | |
| Gelatin | 3 g |
| $HO-(CH_2CH_2O)_n-(CH_2CH_2CH_2O)_{17}-(CH_2CH_2O)_m-H$ (wherein n + m = 6) (10% ethanol solution) | 0.3 ml |
| Sodium chloride | 20.2 g |
| $Na_3RhCl_6$ (1% aqueous solution) | 0.02 ml |
| Distilled water | 85.61 ml |
| Solution D | |
| Gelatin | 1.4 g |
| $HO-(CH_2CH_2O)_n-(CH_2CH_2CH_2O)_{17}-(CH_2CH_2O)_m-H$ (wherein n + m = 6) (10% ethanol solution) | 0.14 ml |
| Distilled water | 48.8 ml |

The obtained silver halide grains had an average grain diameter of 0.12μ, a rhodium content of $1.0\times10^{-4}$ mole per mole of silver halide and a monodisperse rate of 8 to 15%.

To the above-prepared emulsion was added Solution D, pH was adjusted to 6.0 with sodium carbonate, and added 560 mg of 6-methyl-4-hydroxy-1,3,3a,7-tetrazaindene. After that, each emulsion was washed and desalted in the usual manner, and then Solution E as a preservative was added thereto.

| Solution E | |
|---|---|
| 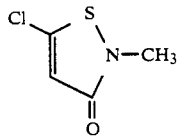 | 15 ml |
| Water | 0.3 ml |

The above emulsion was subjected to sulfur sensitization by adding thereto 6-methyl-4-hydroxy-1,3,3a,7-tetrazaindene in an amount of 60 mg per mole of silver halide and sodium thiosulfate 66 mg per mole of silver halide. After the sulfur sensitization, 6-methyl-4-hydroxy-1,3,3a,7-tetrazaindene as a stabilizer in an amount of 580 mg per mole of silver halide and gelatin 14 g per mole of silver halide were added to the emulsion. Further, the following additives were added, whereby an emulsion layer coating liquid was prepared.

| Additives to emulsion layer coating liquid | |
|---|---|
| 1-Phenyl-5-mercaptotetrazole | 0.2 g |
| Propyl gallate | 0.5 g |
| Saponin | 1.8 g |
| Sodium 1-decyl-2-(3-isopentyl)-succinate-2-sulfonate | 0.1 g |
| Polymer latex (ethyl acrylate/methacrylic acid copolymer) | 14 g |
| Citric acid | 0.1 g |
| Styrene/maleate copolymer | 0.32 g |
| Glyoxal | 0.48 g |
| Formaldehyde | 0.59 g |
| NaCl | 0.007 g |

Next, an emulsion protective layer coating liquid having the following composition was prepared.

| Emulsion protective layer coating liquid | |
|---|---|
| Gelatin | 60 g |
| Water | 470 ml |
| Dioctyl sulfosuccinate | 0.5 g |
| NaCl | 0.4 g |
| Amorphous silica (average particle size 6 μm) | 0.7 g |
| Amorphous silica (average particle size 8 μm) | 1.1 g |
| Dye having Formula A | 6 g |
| Citric acid | 0.2 g |
| Preservative having Formula B | 4 mg |
| Cyanur chloride | 1.5 g |

Formula A

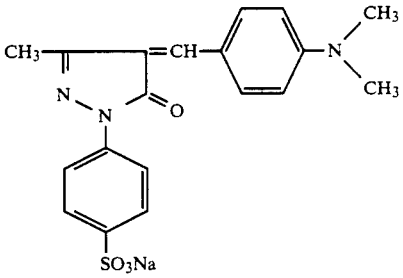

Formula B

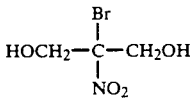

Backing layer and backing protective layer coating liquids having the following compositions were prepared.

| Backing layer | |
|---|---|
| Dye having Formula C | 5.8 g |
| Dye having Formula D | 1.0 g |
| Saponin | 3.6 g |
| Butyl acrylate/vinyl chloride copolymer | 2.5 g |
| Glyoxal | 0.26 g |
| Citric acid | 0.21 g |
| Styrene/sodium maleate copolymer | 0.5 g |

Formula C

-continued

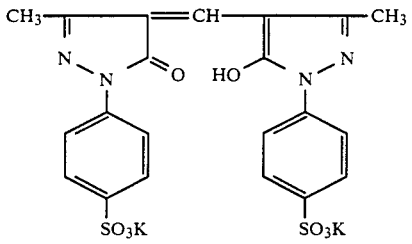

Formula D

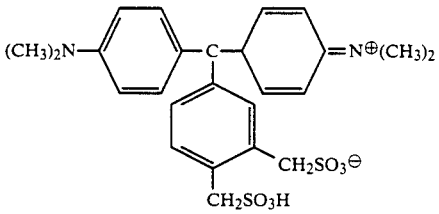

| Backing protective layer | |
|---|---|
| Matting agent: methyl methacrylate | 2.2 g |
| NaCl | 3 g |
| Dioctyl sulfosuccinate | 0.9 g |
| Glyoxal | 1.8 g |

A solution of 1 g of gelatin and 20 mg of saponin dissolved in 100 ml of deionized water was coated to form a 10 μm-thick layer on both sides of a support, and then dried at 100° C. for one minute. On one side of the support, the backing layer was coated and dried so as to have a dry gelatin weight of 2 g/m$^2$, and simultaneously on the backing layer was coated and dried the backing protective layer so as to have a dry gelatin weight of 1 g/m$^2$. Subsequently on the other side of the support was coated and dried the emulsion layer coating liquid so as to have a dry gelatin weight of 1.8 g/m$^2$ and silver weight of 3.2 g/m$^2$, and on the emulsion layer was coated and dried the emulsion protective layer coating liquid so as to have a dry gelatin weight of 0.8 g/m$^2$, whereby a sample was prepared.

Coating, Drying Conditions

The coating liquid was coated at 35° C., then cooled to be set by being placed for 6 seconds in cooling air at 5° C., and then dried by air at a dry bulb temperature of 23° C. with a relative humidity of 20% until the coated surface temperature and the water content of the gelatin of the coated layer reach 10° C. and 1600%, respectively. Subsequently, the layer was dried by air at a dry bulb temperature of 27° C. with a relative humidity of 20%, and then by air at a dry bulb temperature of 34° C. with a relative humidity of 43% until the water content of the coated layer reaches 60%. Five seconds after that, the coated surface was rehumidified for 40 seconds under the combined conditions a, b, c and d given in the following Table 1, with a heat-transfer coefficient of 100 Kcal/hr/m$^2$.

TABLE 1

| Combined condition | Backing layer side rehumidifying condition | Emulsion layer side rehumidifying condition |
|---|---|---|
| a | Dry bulb temp. 25° C. Relative humidity 50% (Condition A) | The same as Condition A |
| b | The same as Condition A | The same as Condition B |
| c | Dry bulb temp. 40° C. Relative humidity 10% (Condition B) | The same as Condition A |
| d | The same as Condition B | The same as Condition B |

Each rehumidified sample, after spot marks were carved thereon at intervals of 560 mm at an ambient temperature of 23° C. and a relative humidity of 40%, was processed in an automatic processor GR-26, manufactured by KONICA Corporation. The sample was processed for 20 seconds at 38° C. with a developer CDM-621 and a fixer CFL-851, both produced by the same corporation, and dried at 45° C. in the automatic processor. The intervals between the carved marks on the processed sample were measured to find varied values for dimensional stability evaluation.

Film strips cut from the sample were enclosed in moisture-tight bags made of black polyethylene with their inside relative humidity kept so as to be 20% RH at 23° C. and 55% RH at 23° C., the bags were hermetically sealed by heating and then allowed to stand for 6 months in a room maintained at 23° C. for the above dimensional stability test. The packing material pieces enclosed along with the film, after being subjected to incubation treatment, were conditioned for three days to the above respective humidities, and the water content rates of the pieces to the weight thereof were 5% and 6.5%, respectively. The water content of the packing material was measured with a Moistlec 2000-D-3M water content tester.

TABLE 2

| Sample No. | Hydrophobic polymer layer: Polymer | Hydrophobic polymer layer: Thickness(μ) | Emulsion, backing layers rehumidifying conditions | Surface cracks | Dimensional stability (μm) |
|---|---|---|---|---|---|
| 1 | I | 0 | d | A | +90 |
| 2 | I | 0.3 | d | A | +5 |
| 3 | I | 0.5 | a | A | +85 |
| 4 | I | 0.5 | b | A | +2 |
| 5 | I | 0.5 | c | A | +1 |
| 6 | I | 0.5 | d | A | −1 |
| 7 | I | 1.0 | d | A | +2 |
| 8 | II | 0.3 | d | C | +6 |
| 9 | II | 0.5 | a | A | +70 |
| 10 | II | 0.5 | b | B | +15 |
| 11 | II | 0.5 | c | B | +10 |
| 12 | II | 0.5 | d | B | +2 |
| 13 | II | 1.0 | d | B | +1 |
| 14 | III | 0.3 | d | C | +11 |
| 15 | III | 0.5 | b | B | +5 |
| 16 | III | 0.5 | d | B | +3 |
| 17 | III | 1.0 | d | B | −2 |

A: No cracks, B: Partial cracks, C: Conspicuous cracks.

TABLE 3

| Sample No. | Polymer* | Emulsion, backing layers rehumidifying conditions | (Aging test) Immediate dimensional stability(μm) after sealing | Dimensional stability(μm) 6 months after sealing Inside temp./humidity 23° C./20% RH | 23° C./55% RH |
|---|---|---|---|---|---|
| 18 | I | a | +85 | +80 | +90 |
| 19 | I | b | +2 | +1 | +25 |
| 20 | I | c | +1 | ±0 | +20 |
| 21 | I | d | −1 | ±1 | +25 |

*Thickness of polymer layer: 0.5 μm

As is apparent from Table 2, the light-sensitive material samples which were prepared by providing a hydrophilic polymer on the polyvinylidene copolymer-coated polyester support of the invention and treated under the rehumidifying conditions b, c and d given in Table 1 show no cracks on the surface of the coated layer thereof and have excellent dimensional stability after the aging.

As is apparent from Table 3, the light-sensitive material prepared in accordance with the invention, when packed in a sealed moisture-tight bag and stored under the preserving condition of the invention, has its dimensional stability maintained satisfactory over an extensive period of time.

EXAMPLE 2

A silver halide photographic light-sensitive material was prepared in the same manner as in Example 1 except that vinylidene chloride copolymer I of the invention (vinylidene chloride/methyl acrylate/acrylic acid copolymer=90:5:5) was used as the hydrophobic polymer and the thickness of the polymer layer was made 0.5μ and the prepared light-sensitive material was dried in the same manner as in Example 1 except that the rehumidifying conditions after drying were replaced by the conditions given in Table 4. The results are shown in the same table.

TABLE 4

| | Backing, emulsion layers rehumidifying conditions | | | Dimensional stability |
|---|---|---|---|---|
| No. | Temp. | Humidity | Drying time | (μ) |
| 1 | 25° C. | 50% | 10 seconds | +85 |
| 2 | 25° C. | 50% | 1 minute | +80 |
| 3 | 40° C. | 50% | 40 seconds | +71 |
| 4 | 40° C. | 10% | 3 seconds | +50 |
| 5 | 40° C. | 10% | 10 seconds | +5 |
| 6 | 40° C. | 10% | 1 minute | −3 |
| 7 | 40° C. | 25% | 40 seconds | +5 |

As is apparent from Table 4, the sample, when treated at a humidity of from 5 to 25% and dried for a period of 5 seconds or longer, shows satisfactory dimensional stabilities.

EXAMPLE 3

A direct positive silver halide photographic light-sensitive material sample was prepared.

Formation of Polymer Layer

The surface of a biaxially oriented and thermally set polyethylene terephthalate film having a thickness of 100 μm was subjected to corona discharge treatment of 30 $W/m^2/min$.

On the support a coating liquid comprised of !0 ml of the following hydrophobic polymer I, 20 mg of the following surfactant E, 30 mg of hexamethylene-1,6-bis-(ethyleneurea) and 90 ml of deionized water was coated in different thicknesses, and dried at 100° C. for one minute. Next, supports coated on both size thereof with polymer layers were prepared in the same manner as in above except that the hydrophobic polymer I was replaced by the following hydrophobic polymer II or III.

Hydrophobic polymers:

I: Vinylidene chloride/methyl acrylate/acrylic acid =90 : 5 : 5 % by weight

II: Glycidyl methacrylate/methyl acrylate/acrylic acid =90 : 5 : 5 % by weight

III: Glycidyl methacrylate/n-butyl acrylate/styrene =50 : 20 : 30 % by weight

Surfactant E

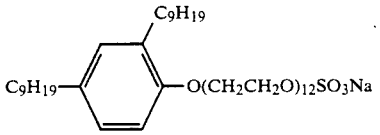

Preparation of Samples

Under a nitric acid atmospheric condition of pH 2.0 at 55° C. with silver potential EAg maintained at 140 mV, the following Solutions B and C were mixed into Solution A by a double-jet method, and 2 minutes after that, Solutions D and E were mixed therewith likewise.

| | |
|---|---|
| Solution A | |
| Distilled water | 456 ml |
| Gelatin | 2 g |
| $HO—(CH_2CH_2O)_n—(CH_2CH_2CH_2O)_{17}—(CH_2CH_2O)_m—H$ (wherein n + m = 6) (10% ethanol solution) | 1 ml |
| KBr | 0.011 g |
| $MgSO_4$ | 0.92 g |
| $HNO_3$ | 0.9 ml |
| Solution B | |
| Distilled water | 33.9 ml |
| $AgNO_3$ | 3.7 g |
| $HNO_3$ | 0.15 ml |
| Solution C | |
| Distilled water | 35 ml |
| Gelatin | 0.5 g |
| $HO—(CH_2CH_2O)_n—(CH_2CH_2CH_2O)_{17}—(CH_2CH_2O)_m—H$ (wherein n + m = 6) (10% ethanol solution) | 0.2 ml |
| KBr | 2.6 g |
| Solution D | |
| Distilled water | 123 ml |
| $AgNO_3$ | 56 g |
| $HNO_3$ | 0.47 ml |
| Solution E | |
| Distilled water | 124 ml |
| Gelatin | 1.7 g |
| $HO—(CH_2CH_2O)_n—(CH_2CH_2CH_2O)_{17}—(CH_2CH_2O)_m—H$ (wherein n + m = 6) (10% ethanol solution) | 0.5 ml |
| KBr | 39.4 g |
| $Na_3RhCl_6$ (1% aqueous solution) | 0.9 ml |

After completion of the mixing, to the mixture the following Solution F was added, pH was adjusted to 5.5 with an NaOH solution, the following Solution G was added, then washed and desalted in the usual manner, and then the following Solution H was added.

| | |
|---|---|
| Solution F | |
| Distilled Water | 31.4 ml |
| KBr | 5 g |
| Solution G | |
| Distilled water | 90 ml |
| Gelatin | 8 g |
| $HO(CH_2CH_2O)_n(CH_2CH_2CH_2O)_{17}(CH_2CH_2O)_mH$ (wherein n + m = 6) (10% ethanol solution) | 1.5 ml |
| Solution H | |

-continued

| | |
|---|---|
| 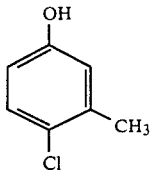 | 0.2 g |
| Methanol | 4 ml |

The above emulsion, after adding 1.6 ml of a 10% sodium carbonate solution thereto, was chemically sensitized with thiourea oxide. Thereafter, to the emulsion were added gelatin and chloroauric acid, and further the following additives for emulsion layer coating, whereby an emulsion layer coating liquid was prepared.

| Additives for emulsion layer coating | |
|---|---|
| 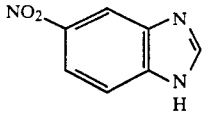 (1% methanol solution) | 21 ml |
| 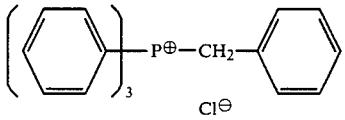 | 0.09 g |
| Saponin | 1.4 g |
| Styrene/maleate copolymer | 1.4 g |

The following emulsion protective layer coating liquid was prepared.

| Emulsion protective layer coating liquid | |
|---|---|
| Gelatin | 60 g |
| Distilled water | 1180 ml |
| Dioctyl sulfosuccinate | 0.7 g |
| Amorphous silica (average particle size 3 μm) | 0.3 g |
| Formaline | 7.1 ml |
| NaCl | 0.025 g |
| Dye I | 3.9 g |
| 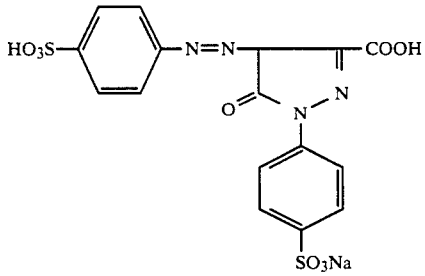 | |

Besides, another protective layer coating liquid excluding the Dye I was prepared.

Subsequently, the following layer and backing protective layer were prepared.

-continued

| | |
|---|---|
| Dye 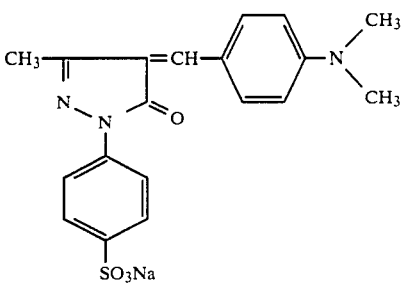 | 5.2 g |
| Dye 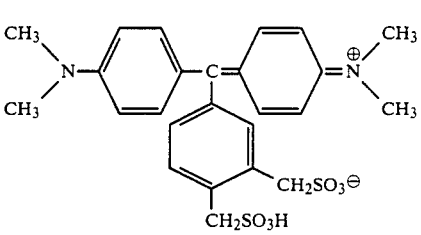 | 2.2 g |
| Saponin | 4.4 g |
| Butyl acrylate/vinyl chloride copolymer | 2.5 g |
| Glyoxal | 0.3 g |
| Citric acid | 0.42 g |
| Styrene/sodium maleate copolymer | 1.1 g |
| Backing protective layer | |
| Gelatin | 65 g |
| Matting agent: Methyl methacrylate | 2 g |
| NaCl | 3.5 g |
| Dioctyl sulfosuccinate | 0.9 g |
| Glyoxal | 1.8 g |

A coating liquid of 1 g of gelatin and 20 mg of saponin dissolved in 100 ml of deionized water was coated to be 10 μm thick on both hydrophobic polymer-coated sides of the previously prepared support. On one side of the support was formed a backing layer so as to make its dry gelatin weight 2 g/m$^2$ and at the same time on the backing layer was formed a backing protective layer so as to make its dry gelatin weight 1 g/m$^2$.

Subsequently, on the other side of the support was coated the emulsion layer coating liquid so as to make its dry gelatin weight 1.8 g/m$^2$ and its silver weight 3.4 g/m$^2$, and on the emulsion layer was coated the emulsion protective layer coating liquid so as to make its dry gelatin weight 0.8 g/m$^2$.

The coating liquid was coated at 35° C., the coated layer was cooled to be set by cooling air at 5° C. for 6 seconds and dried by air at a dry bulb temperature of 23° C. and a relative humidity of 20% until the coated surface temperature and the water content of the gelatin of the coated layer reach 10° C. and 1600%, respectively, then dried by air at a dry bulb temperature of 27° C. and a relative humidity of 20%, and again dried by air at a dry bulb temperature of 34° C. and a relative humidity of 43% until the water content of the coated layer reaches 60%. Five seconds after that, the layer was rehumidified for a period of 40 seconds under the combined conditions a, b, c and d described in Table 5, with a heat-transfer coefficient of 100 Kcal/hr/m$^2$.

TABLE 5

| Combined condition | Backing layer side rehumidifying conditions | Emulsion layer side rehumidifying conditions |
|---|---|---|
| a | Dry bulb temp. 25° C. Relative humidity 50% (Condition A) | The same as Condition A |

TABLE 5-continued

| Combined condition | Backing layer side rehumidifying conditions | Emulsion layer side rehumidifying conditions |
|---|---|---|
| b | The same as Condition A | The same as Condition B |
| c | Dry bulb temp. 40° C. Relative humidity 10% (Condition B) | The same as Condition A |
| d | The same as Condition B | The same as Condition B |

Each sample obtained in the above manner, after spot marks were carved thereon at intervals of 560 mm, was processed in an automatic processor GR-26, manufactured by KONICA Corporation, in which the sample was processed for 20 seconds at 38° C. with a developer CDM-621 and a fixer CFL-851 and dried at a temperature of 45° C. The dimensional stability of the sample was evaluated in the same manner as in Example 1.

Film pieces cut from the sample were put in moisture-tight bags with their inside atmosphere maintained at 23° C. with 20% RH and 23° C. with 55% RH, and the bags were hermetically sealed and allowed to stand for 6 months in a room kept at a temperature of 23° C. for dimensional stability examination. The packing material enclosed together with the film, after being subjected to incubation treatment, was rehumidified for three days under the same respective conditions. The water content rates of the material were 4% and 6.5% by weight, respectively. Measurement of the water content was performed with a Moistlec 2000-D-3M water content tester.

TABLE 6

| Sample No. | Hydrophobic polymer layer: Polymer | Hydrophobic polymer layer: Thickness(μ) | Emulsion, backing layers rehumidifying conditions | Surface cracks | Dimensional stability (μm) |
|---|---|---|---|---|---|
| 1 | I | 0 | d | A | +95 |
| 2 | I | 0.3 | d | A | +3 |
| 3 | I | 0.5 | a | A | +90 |
| 4 | I | 0.5 | b | A | +1 |
| 5 | I | 0.5 | c | A | +1 |
| 6 | I | 0.5 | d | A | +1 |
| 7 | I | 1.0 | d | A | −1 |
| 8 | II | 0.3 | d | C | +5 |
| 9 | II | 0.5 | a | A | +80 |
| 10 | II | 0.5 | b | B | +13 |
| 11 | II | 0.5 | c | B | +10 |
| 12 | II | 0.5 | d | B | +3 |
| 13 | II | 1.0 | d | B | +1 |
| 14 | III | 0.3 | d | C | +13 |
| 15 | III | 0.5 | b | B | +6 |
| 16 | III | 0.5 | d | B | +3 |
| 17 | III | 1.0 | d | B | −2 |

A: No cracks, B: Partial cracks, C: Conspicuous cracks.

TABLE 7

| Sample No. | Polymer* | Emulsion, backing layers rehumidifying conditions | (Aging test) Immediate dimensional stability(μm) after sealing | Dimensional stability(μm) 6 months after sealing Inside temp./humidity 23° C./20% RH | 23° C./55% RH |
|---|---|---|---|---|---|
| 18 | I | a | +90 | +85 | +97 |
| 19 | I | b | +1 | +1 | +30 |
| 20 | I | c | +1 | ±0 | +35 |
| 21 | I | d | +1 | ±0 | +33 |

*Thickness of polymer layer: 0.5 μm

As is apparent from Table 6, the light-sensitive material of the invention has an excellent dimensional stability and shows no surface cracks in drying.

As is apparent from Table 7, the sample that was hermetically sealed under the atmospheric condition of 23° C. and 20% RH shows the least dimensional stability deterioration with time.

What is claimed is:

1. A method of preparing a light sensitive silver halide photographic material which comprises a polyester support having thereon a hydrophobic polymer layer containing a vinylidene chloride copolymer and at least one hydrophilic polymer layer which is a silver halide emulsion layer, which method comprises;

(a) coating a hydrophilic polymer layer onto the polyester support having thereon said hydrophobic polymer layer containing a vinylidene chloride copolymer, (b) drying the layer until a water content of the layer reaches 60 wt. %, and (c) contacting the layer with air having a relative humidity of 5 to 25% for a period of 5 seconds to 10 minutes.

2. A method of claim 1, which comprises cooling the coated hydrophilic layer to be set in a low-temperature air having a dry-bulb temperature of −10° to 15° C.

3. A method of claim 1, wherein the vinylidene chloride copolymer contains 70 to 99.5 wt. % of vinylidene chloride.

4. A method of claim 1, wherein the polyester support has the hydrophobic layer on each side thereof.

5. A method of claim 1, wherein the contacting step (c) commences within 2 minutes of the layer reaching a water content of 60 wt. %.

6. A method of claim 5, wherein the contacting step commences within 1 minutes of the layer reaching a water content of 60 wt. %.

* * * * *

UNITED STATES PATENT AND TRADEMARK OFFICE

CERTIFICATE OF CORRECTION

PATENT NO. : 5,061,611

DATED : October 29, 1991

INVENTOR(S) : HIDEAKI SAKATA ET AL.

It is certified that error appears in the above-identified patent and that said Letters Patent is hereby corrected as shown below:

Abstract, line 2, change "phtographic" to --photographic--.

Abstract, line 12, after "such" Delete "a".

Claim 5, column 18, line 45, change "A" to --The--.

Claim 6, column 18, line 48, change "A" to The -- and after "step" insert --(c)--.

Claim 6, column 18, line 49, change "minutes" to --minute--.

Signed and Sealed this

Twentieth Day of April, 1993

*Attest:*

MICHAEL K. KIRK

*Attesting Officer*

*Acting Commissioner of Patents and Trademarks*